US009175471B2

(12) United States Patent
Ting

(10) Patent No.: US 9,175,471 B2
(45) Date of Patent: Nov. 3, 2015

(54) AIRLOOP WINDOW WALL FOR MODULAR CONSTRUCTION TECHNOLOGY

(71) Applicant: Advanced Building Systems, Inc., Wilmington, DE (US)

(72) Inventor: Raymond M. L. Ting, Pittsburgh, PA (US)

(73) Assignee: Advanced Building Systems, Inc., Wilmington, DE (US)

( * ) Notice: Subject to any disclaimer, the term of this patent is extended or adjusted under 35 U.S.C. 154(b) by 0 days.

(21) Appl. No.: 14/471,978

(22) Filed: Aug. 28, 2014

(65) Prior Publication Data

US 2015/0059269 A1 Mar. 5, 2015

Related U.S. Application Data

(60) Provisional application No. 61/871,113, filed on Aug. 28, 2013.

(51) Int. Cl.

| | |
|---|---|
| ***E04H 1/00*** | (2006.01) |
| ***E04B 2/90*** | (2006.01) |
| ***E04B 2/88*** | (2006.01) |
| *E04B 2/96* | (2006.01) |

(52) U.S. Cl.

CPC ... *E04B 2/90* (2013.01); *E04B 2/88* (2013.01); *E04B 2/967* (2013.01)

(58) Field of Classification Search

CPC ..... E06B 7/14; E06B 3/4609; E04B 2/96; E04B 2/967; E04B 2/88; E04B 2/965; E04B 2/90

USPC ..... 52/204.593, 204.597, 204.6, 235

See application file for complete search history.

(56) References Cited

U.S. PATENT DOCUMENTS

| | | | | | |
|---|---|---|---|---|---|
| 2,916,108 | A | * | 12/1959 | Gartner | 52/206 |
| 3,665,666 | A | * | 5/1972 | Delcroix | 52/461 |
| 3,921,355 | A | * | 11/1975 | Pennecot | 52/262 |
| 4,685,263 | A | | 8/1987 | Ting | |
| 4,765,107 | A | | 8/1988 | Ting | |
| 4,840,004 | A | | 6/1989 | Ting | |
| 4,873,805 | A | | 10/1989 | Ting | |
| 5,154,029 | A | * | 10/1992 | Sturgeon | 52/235 |
| 5,452,552 | A | * | 9/1995 | Ting | 52/235 |
| 5,596,851 | A | | 1/1997 | Ting | |
| 5,598,671 | A | | 2/1997 | Ting | |
| 5,687,524 | A | * | 11/1997 | Ting | 52/461 |
| 6,393,778 | B1 | * | 5/2002 | Ting | 52/204.5 |
| 6,591,562 | B2 | | 7/2003 | Ting | |
| 6,598,361 | B2 | | 7/2003 | Ting | |
| 6,662,512 | B2 | * | 12/2003 | Westphal | 52/204.5 |
| 7,134,247 | B2 | * | 11/2006 | Ting | 52/235 |
| 8,001,738 | B2 | * | 8/2011 | Ting | 52/235 |
| 8,191,325 | B2 | * | 6/2012 | Ting | 52/235 |
| 2003/0221381 | A1 | | 12/2003 | Ting | |
| 2008/0216424 | A1 | * | 9/2008 | Westphal et al. | 52/204.5 |

* cited by examiner

*Primary Examiner* — Basil Katcheves
*Assistant Examiner* — Joshua Ihezie
(74) *Attorney, Agent, or Firm* — Beck & Thomas, P.C.

(57) ABSTRACT

An Airloop window wall system for use in modular construction technology. The Airloop window wall system is designed for installation of wall panels from the exterior of a modular unit. Additionally disclosed are horizontal butt joint panels to cover the horizontal butt joints between vertically-adjacent modular units, and Airloop vertical butt joint panels to cover vertical butt joints between horizontally adjacent modular units, while providing a continuous Airloop system for water-tightness performance.

3 Claims, 7 Drawing Sheets

AIRLOOP WINDOW WALL FOR MODULAR CONSTRUCTION TECHNOLOGY

CROSS-REFERENCE TO RELATED APPLICATIONS

This application claims the benefit under 35 U.S.C. §119 (e) of the earlier filing date of U.S. Provisional Patent Application No. 61/871,113 filed on Aug. 28, 2013.

BACKGROUND OF THE INVENTION

1. Field of Invention

This invention is generally related to the building trades and more specifically to building envelope system designs applicable to an exterior window wall system for use in modular construction technology.

2. Description of the Background

In an effort to significantly minimize field erection time, the relatively new construction technology known as Modular Construction Technology (MCT) has continuously gained popularity. In MCT, the entire building is constructed by connecting multiple shop assembled shippable units in the field. Each shippable unit is shop fabricated with mostly completed interior finishes and weather sealed exterior walls. In this type of construction, the horizontal and vertical butt joints between two adjacent units must be sealed and finished in the field with the consideration of construction tolerances between the two adjacent units. Due to this field requirement, the butt joint cover becomes a special aesthetic feature of the wall, making it extremely difficult to maintain a smooth and uninterrupted appearance if a curtain wall or window wall is desired.

In addition, during the process of joining the units together, any exterior wall within a unit must be weather tight against water infiltration. In consideration of all the above difficulties, most buildings constructed by MCT use punched-out windows on the exterior wall. If a curtain wall is desirable on the completed building, providing a weather tight design along the unit perimeters and inserting a curtain wall panel at the unit butt joint locations are extremely difficult, if not impossible, due to the fact that the curtain wall supporting mullions are located outside of the floor slab edge.

If a window wall is desired, extensive design and field execution efforts are required to make the butt joint cover as a special aesthetic feature and to weather seal the butt joints. In addition, window wall systems in today's market are designed for on-floor installation from the interior side, eliminating the need for expensive exterior access equipment in high-rise construction. In MCT, each unit is one floor height sitting on the shop floor and it is desirable to complete interior finishing work such as installing toilets, kitchen countertops, plumbing, electrical, ceiling, drywall, paint, and carpeting, etc. without an enclosed window wall for easy access. Therefore, in MCT, it is desirable to erect the window wall on the unit from the exterior side after the completion of the interior finishing work.

An Airloop window wall system, as described in U.S. Pat. No. 8,001,738, which is hereby incorporated by reference, is particularly desirable for its durable water-tightness performance.

SUMMARY OF THE INVENTION

The present invention relates to an Airloop window wall system for MCT.

One objective of the present invention is to provide an Airloop window wall system for erecting from the exterior side on a MCT unit with a complete weather seal along all four sides of the unit opening (base, ceiling, and two side jambs).

A second objective of the present invention is to provide an uninterrupted Airloop window wall system design across both the horizontal and the vertical unit butt joints with easy field installation procedures.

BRIEF DESCRIPTION OF THE DRAWINGS

To be clearly understood and readily practiced, the present invention will be described in conjunction with the following figures, wherein like reference characters designate the same or similar elements, which figures are incorporated into and constitute a part of the specification, wherein.

DETAILED DESCRIPTION OF THE INVENTION

It is to be understood that the figures and descriptions of the present invention have been simplified to illustrate elements that are relevant for a clear understanding of the invention, while eliminating, for purposes of clarity, other elements that may be well known. The detailed description will be provided herein below with reference to the attached drawings.

Figure 1:
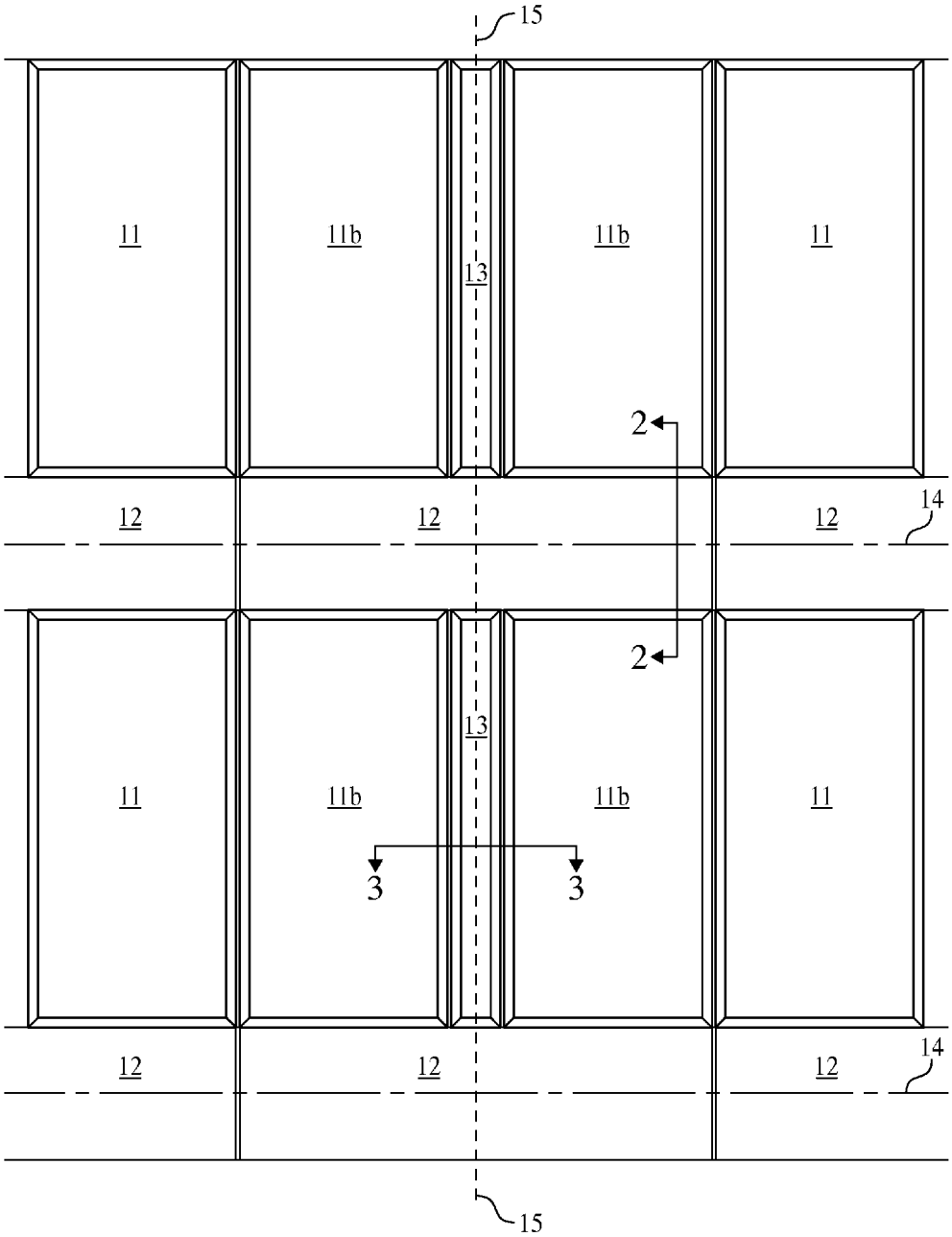
FIG. 1 shows the partial front view of a typical exposed frame insulated glass Airloop window wall system of the present invention.

FIG. 1 shows the partial front view of a typical exposed frame insulated glass Airloop window wall system of the present invention, showing modular units joined at horizontal butt joint 14 and vertical butt joint 15. The wall panels 11 and corner wall panels 11*b* are shop installed panels. "Corner wall panel" refers to a panel at an end of a modular unit that will be joined to the end of an adjacent modular unit at a vertical butt joint. Slab edge cover panels 12 are field installed over the horizontal butt joints 14 of the modular units. Vertical butt joint panels 13 are field installed over the vertical butt joints 15 of the modular units.

Each wall panel 11, corner wall panel 11*b*, and vertical butt joint panel 13 has a head frame, two jamb frames, and a sill frame. The frame corners are miter matched such that the air spaces in the frame members are inter-connected to form an inner airloop. An outer airloop is formed through inter-connected air spaces surrounding the frame members. Specifically, the air space between a wall panel head frame and the ceiling positioning track 28*c* (shown in FIG. 2), the air space between special jamb frame 11*c* and vertical panel joint member 33 (shown in FIG. 3), the air space between jamb frame member lie and vertical panel joint member 33 (shown in FIG. 3), and the air space between a wall panel sill frame and the base positioning track 24*c* (shown in FIG. 2) are interconnected to for form an outer airloop. The outer airloop is exposed to exterior air via air holes, and the inner airloop is inter-connected to the outer airloop via air holes, providing pressure equalization of both airloops with exterior air. Application of this pressure-equalized airloop system achieves durable water-tightness performance. Implementation of the airloop principle in a window wall system is further described in U.S. Pat. No. 8,001,738.

Figure 2:
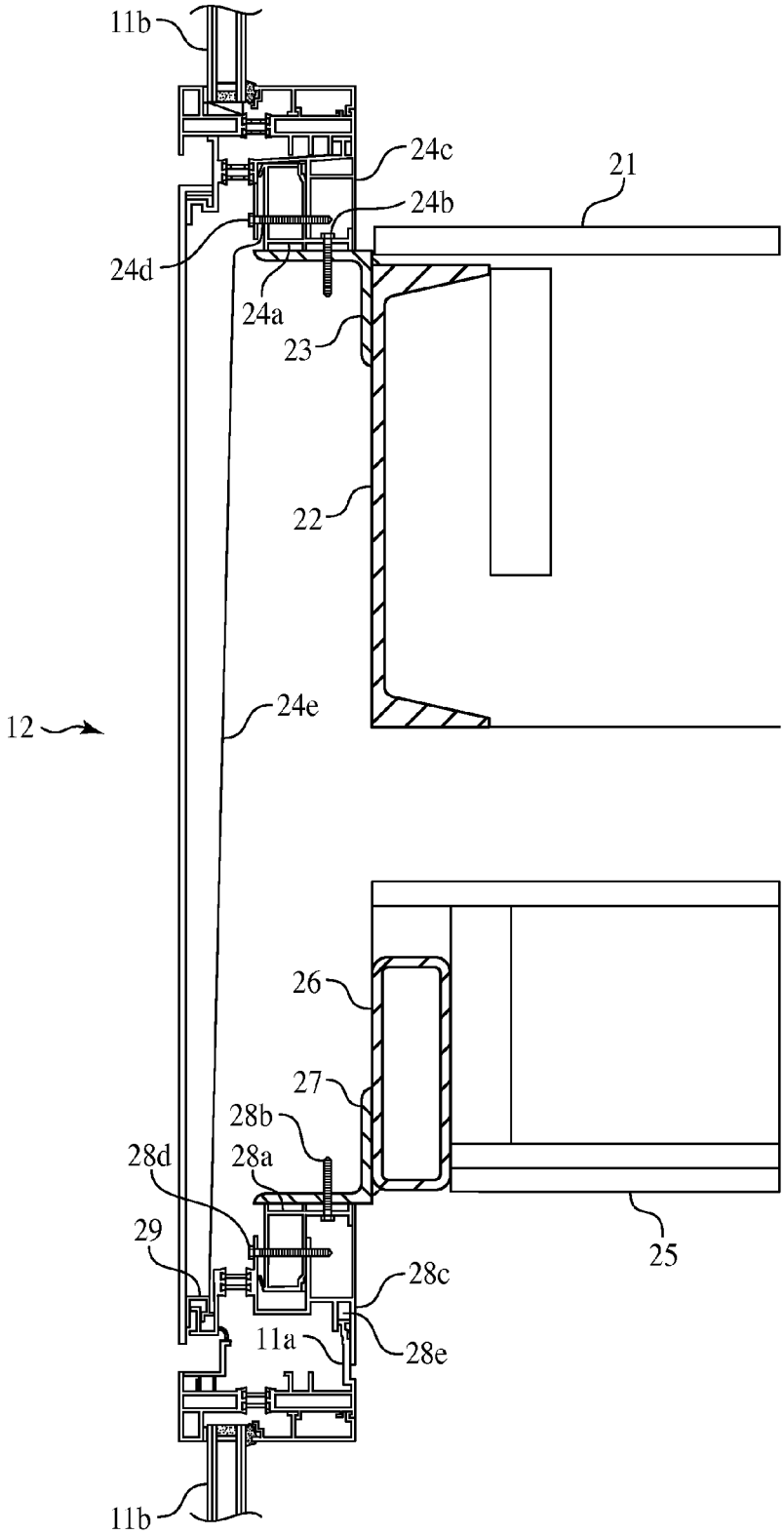
FIG. 2 is the fragmental cross-section at the horizontal butt joint of the modular units taken along Line 2-2 of FIG. 1.

FIG. 2 is the fragmental cross-section at a representative horizontal butt joint 14 of two modular units taken along Line 2-2 of FIG. 1. FIG. 2, therefore, shows the top (ceiling) end of one representative modular unit, and the bottom (floor) end of an adjacent representative modular unit. A horizontal butt joint cover panel 12 of the present invention may be employed to cover the horizontal butt joint. The top of FIG. 2 displays the floor 21 of a building story, while the bottom of the figure displays the ceiling 25 of the next lower building story. Accordingly, the sill end of the upper wall panel 11*b* and the head end of the lower wall panel 11*b* are visible. Within the context of the entire building project, the structure of both the sill and head portions of the wall panels (as well as the structures for attaching the wall panels to the floor and ceiling, respectively) are repeated for each wall panel utilized, though only one set of representative wall panel ends are shown in FIG. 2.

In a typical modular unit, a shop finished floor 21 is supported on the floor perimeter beam 22. A window wall base support member 23 is structurally secured and air sealed to the floor beam 22. A base anchoring track 24*a* is attached to the base support member 23 at the desired in-and-out position with a series of fasteners 24*b*. A base positioning track 24*c* is engaged with the base anchoring track 24*a*, and secured at the desired vertical position with fasteners 24*d*. Tight engagement of the base positioning track 24*c* with base anchoring track 24*a* facilitates precise adjustment of the vertical position of base positioning track 24*c*. The panel sill frame of corner wall panel 11*b* is structurally engaged to positioning track 24*c*.

The window wall ceiling support member 27 is structurally secured and air sealed to the ceiling perimeter beam 26. A ceiling anchoring track 28*a* is attached to the ceiling support member 27 at the desired in-and-out position with a series of fasteners 28*b*. A ceiling positioning track 28*c* is engaged with the ceiling anchoring track 28*a*, and secured at the desired vertical position with fasteners 28*d*. Tight engagement of the ceiling positioning track 28*c* with the ceiling anchoring track 28*a* facilitates precise adjustment of the vertical position of ceiling positioning track 28*c*. The head frame of corner wall panel 11*b* is structurally engaged to ceiling positioning track 28*c*.

When vertically-adjacent modular units are installed, they meet at a horizontal butt joint 14. A horizontal butt joint membrane 24*e* spans the horizontal butt joint to prevent wetting of the floor slab and ceiling of the adjacent modular units, and to act as a drain flashing. The horizontal butt joint membrane 24*e* may be made of a rigid metal base flashing, but membrane material is preferred due to its ability to follow irregular edge conditions of the floor slab, and for ease of installation and shipment of modular units, as described below.

Shop erection of the Airloop window wall system of the present invention may be completed with the following steps for each modular unit, typically after completion of most of the interior finishes of a modular unit. (1) Secure the base anchoring track 24*a* to the base support member 23 at the desired in-and-out position with spaced apart fasteners 24*b*. (2) Attach the horizontal butt joint membrane 24*e* to the base anchoring track 24*a*. The horizontal butt joint membrane 24*e* is preferably a membrane material that can be rolled up and temporarily secured to the floor beam 22 for shipping. (3) Engage the base positioning track 24*c* onto the base anchoring track 24*a* with vertical position adjustment if necessary, and secure the base positioning track 24*c* to the base anchoring track 24*a* with spaced apart fasteners 24*d*. (4) Secure the ceiling anchoring track 28*a* to the ceiling support 27 with spaced apart fasteners 28*b*. (5) Engage the ceiling positioning track 28*c* onto the ceiling anchoring track 28*a* with vertical position adjustment if necessary and secure the ceiling positioning track 28*c* to the ceiling anchoring track 28*a* with spaced apart fasteners 28*d*.

Unlike the Airloop window wall system described in U.S. Pat. No. 8,001,738, which is designed for wall panel installation from the interior side of the building, the ceiling positioning track 28*c* of the present invention is adapted for wall panel installation from the exterior side of a modular unit. In U.S. Pat. No. 8,001,738, a wall panel is installed by tilting the top of the wall panel outwardly from the interior side of the building, such that the head frame of the wall panel contacts a ceiling track. From the inside of the building, a head retainer is then installed to secure the head frame of the wall panel to the ceiling track. That installation procedure could not be used for wall panel installation from the exterior side of the building because the completion of interior finishes prior to exterior wall installation in modular units would prevent interior access needed to install the wall panel from the inside of the modular unit.

In the preferred embodiment of the present invention shown in FIG. 2, a female joint 28*e*, adapted for engagement of male lip 11*a* of the head frame of the corner wall panel 11*b*, is provided on ceiling positioning track 28*c*. The female joint 28*e* permits engagement of the head frame of corner wall panel 11*b* with ceiling positioning track 28*c*, from the exterior side of the modular unit, as described below. A head retainer installed from the interior side is not necessary to secure the head frame of corner wall panel 11*b* to the ceiling positioning track 28*c*.

(6) Next, install the corner wall panel 11*b* starting from one modular unit corner by engaging male lip 11*a* provided on the head frame of corner wall panel 11*b* with female joint 28*e* of the ceiling positioning track 28*c*, and move the corner wall panel 11*b* upwardly to clear the panel bottom for engagement of the sill frame of corner wall panel 11*b* with the base positioning track 24*c*. (7) Move corner wall panel 11*b* laterally to engage the special jamb frame 11*c* of the corner panel 11*b* with the wall corner clip 34 shown on FIG. 3.

(8) Next, prepare the corner panel 11*b* for lateral engagement with adjacent regular panel 11. The vertical edge of corner panel 11*b* that will be joined with regular panel 11 (i.e., the vertical edge that is not at the end of the modular unit, not shown) includes a regular jamb frame with the same profile as the regular jamb frame 11*e* shown in FIG. 3. Insert a vertical panel joint member with the same profile as the vertical panel joint member 33 shown on FIG. 3 onto the regular jamb frame. (9) Install regular wall panel 11 adjacent to corner wall panel 11*b* in the same manner described for corner wall panel 11*b* in step (6) above. (10) Move regular wall panel 11 laterally to engage regular wall panel 11 with corner wall panel 11*b* via the vertical panel joint member inserted in step (8), as follows. Regular wall panel 11 has regular jamb frames (not shown) on both vertical edges with the same profile as regular jamb frame 11*e* shown in FIG. 3. The regular jamb frame is engaged with the vertical panel joint member in the same manner shown in FIG. 3. (11) Insert another vertical panel joint member and repeat steps (9) and (10) for successive regular wall panels. (12) Install a corner wall panel in a similar manner at the end of the modular unit.

The cross-section of the horizontal butt joint, as shown in FIG. 2, is the same for corner wall panels 11*b* and for regular wall panels 11. The above procedures illustrate window wall erection from the exterior side in the shop.

The field installation to cover the horizontal butt joint of the modular units includes the following steps: (1) Install butt joint insulation material (not shown) if desirable. (2) If a membrane material was used for horizontal butt joint membrane 24*e* and rolled up and temporarily secured to the floor beam 22 for shipping, then roll down membrane 24*e* and position it to direct water to the outside. (3) Install the horizontal butt joint cover panel 12 by simultaneously engaging to the base positioning track 24*c* at the top and to the ceiling positioning track 28*c* at the bottom. A double engaging feature 29 at the bottom of the cover panel 12 can be designed to fit the required construction tolerance of the horizontal butt joint of the modular units. In a preferred embodiment, shown in FIG. 2, the horizontal butt joint cover panel 12 is engaged to base positioning track 24*c* and ceiling positioning track 28*c* via a structural male lip provided on the base positioning track 24*c* and a structural male lip provided on the ceiling positioning track 28*c*. The other design features and functions of the Airloop window wall system such as air seal, water seal, and air holes etc. are the same as described in U.S. Pat. No. 8,001,738.

Figure 3:
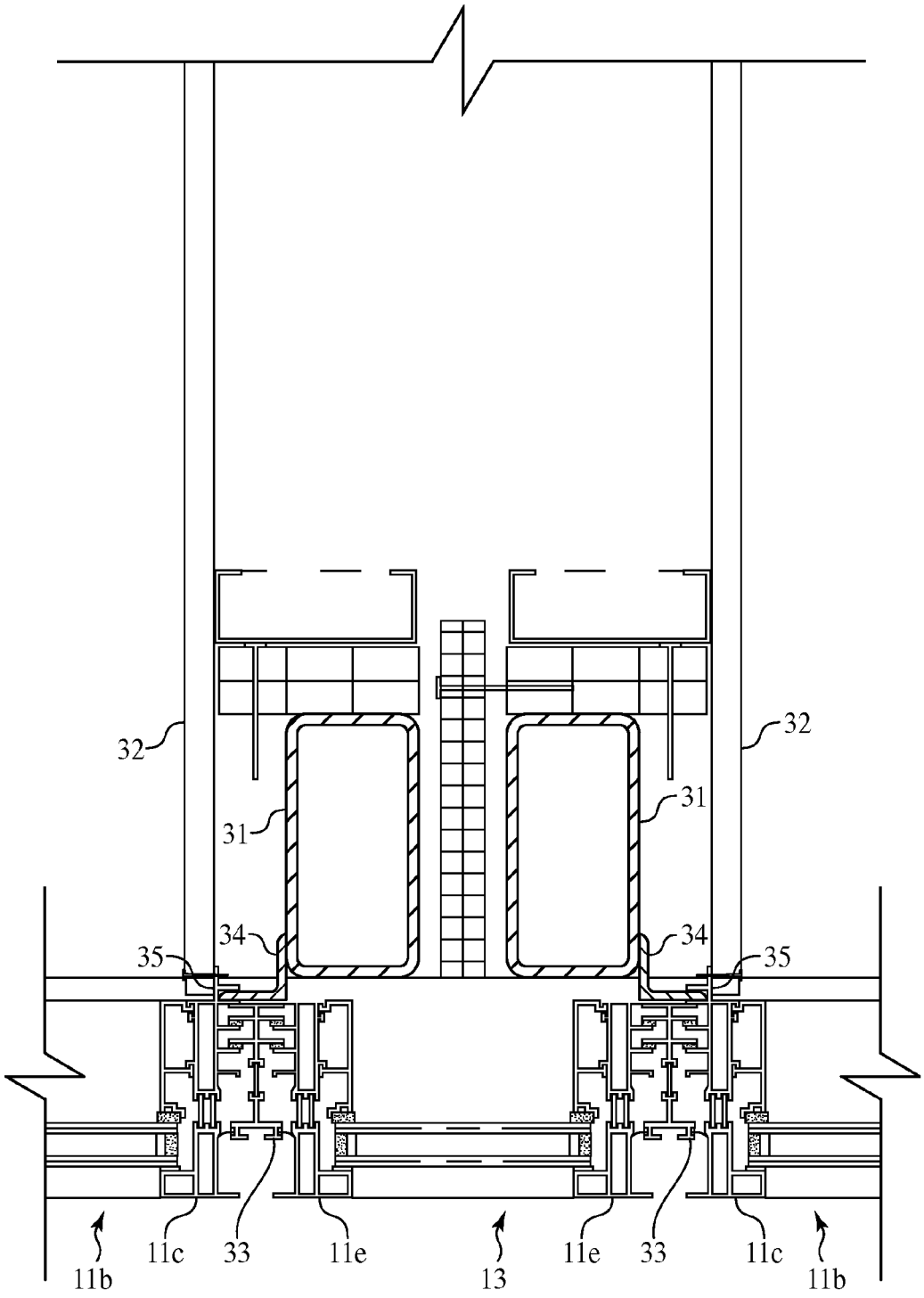
FIG. 3 is the fragmental cross-section of the vertical butt joint of the modular units taken along Line 3-3 of FIG. 1.

FIG. 3 is a fragmental cross-section of the vertical butt joint between two modular units taken along Line 3-3 of FIG. 1. The two members 31 are the corner columns of the butting modular units. The walls 32 are the finished interior walls. The vertical butt joint wall panel 13 is a regular Airloop panel with regular jamb frames lie on each side. The vertical butt joint wall panel 13 is installed to cover the vertical butt joint of the modular units with Airloop vertical joint members 33 engaged inside the panel vertical joints.

The modular unit corner wall panels 11*b* have a special jamb frame 11*c*, for the following reasons. In case of negative wind load, the wind load deflection of the corner jamb frame 11*c* can cause a gap at the corner of the interior finished wall 32; therefore, the wind load deflection of the corner jamb frame 11*c* must be restrained. As shown, the special jamb frame 11*c* has an inwardly extended part 35 with a groove and lip. A structural member or clip 34 is secured to the corner column 31. The member or clip 34 has a male leg to cause structural engagement with the groove in the inwardly extended part 35; thus, the wind load deflection of special jamb frame 11*c* is restrained. The lip of the inwardly extended part 35 is provided for supporting and securing the end of the interior wall 32. In this design, the same Airloop window wall system is continuous through the vertical butt joint of the modular units. The Airloop gap on both sides of the vertical joint members 33 will provide reasonable adjustability for the construction tolerance of the butt joint gap of the butting modular units.

The steps of field installing the vertical butt joint panel 13 are explained in the following figures.

Figure 3A:
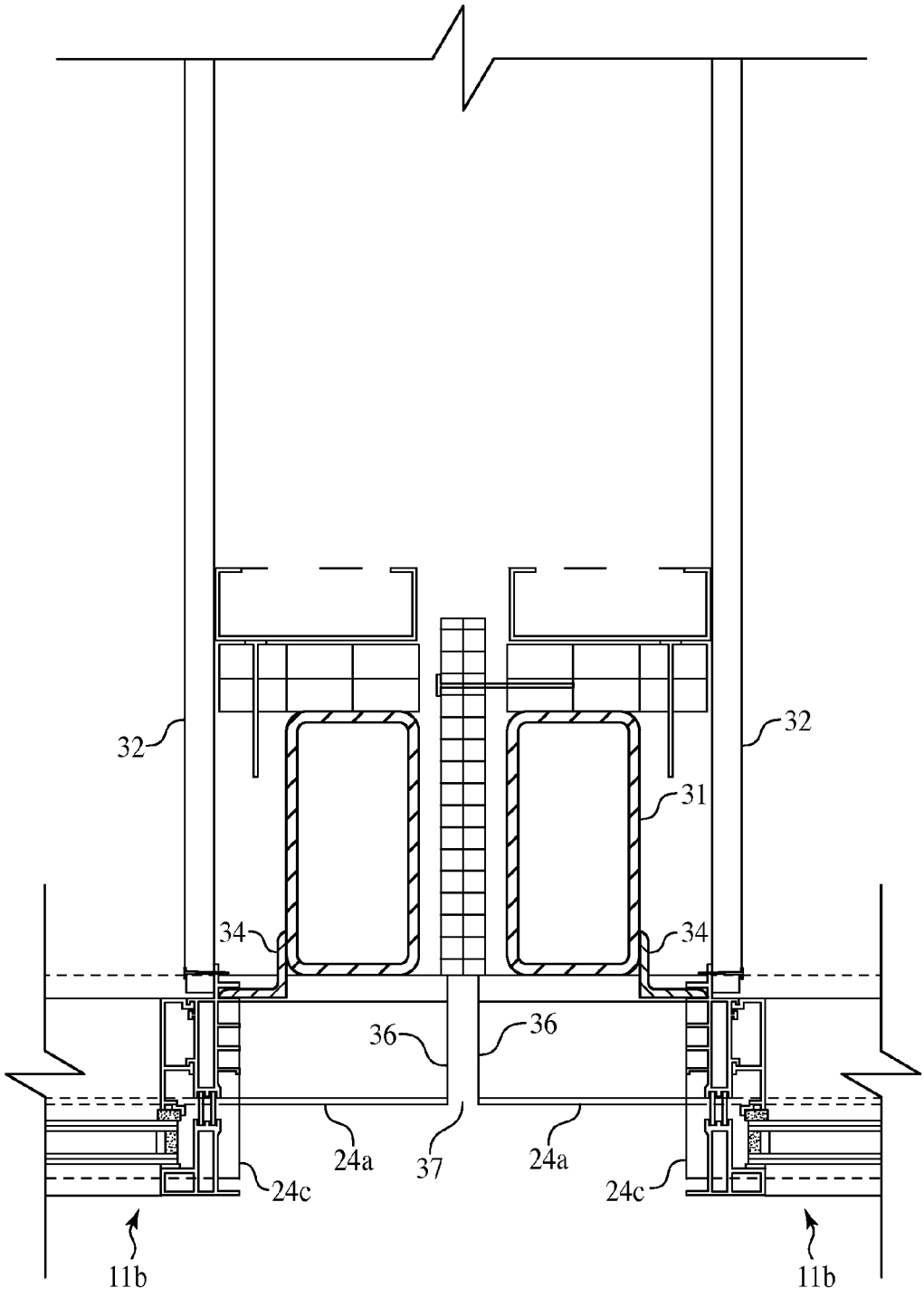
FIG. 3A shows the condition of FIG. 3 with the Airloop anchoring track extended beyond the shop installed window wall before the field installation of the Airloop wall unit at the vertical butt joint.

FIG. 3A shows the condition of FIG. 3 with the base anchoring track 24*a* extended beyond the shop installed corner wall panel 11*b* before the field installation of the Airloop butt joint wall panel 13 at the vertical butt joint of the modular units. The base positioning track 24*c* ends at a location near the outside edge of corner wall panel 11*b*. The line 36 represents the end line of both the base positioning track 24*a* and the base support 23. The gap 37 between the two lines of 36 is designed to absorb the construction tolerance of the vertical butt joint of the modular units. Once the modular units are secured in position, field seal the gap 37 using conventional field sealing procedures such as using backer rod and caulk. Apply similar procedures to the ceiling anchoring track 28*a*.

Figure 3B:
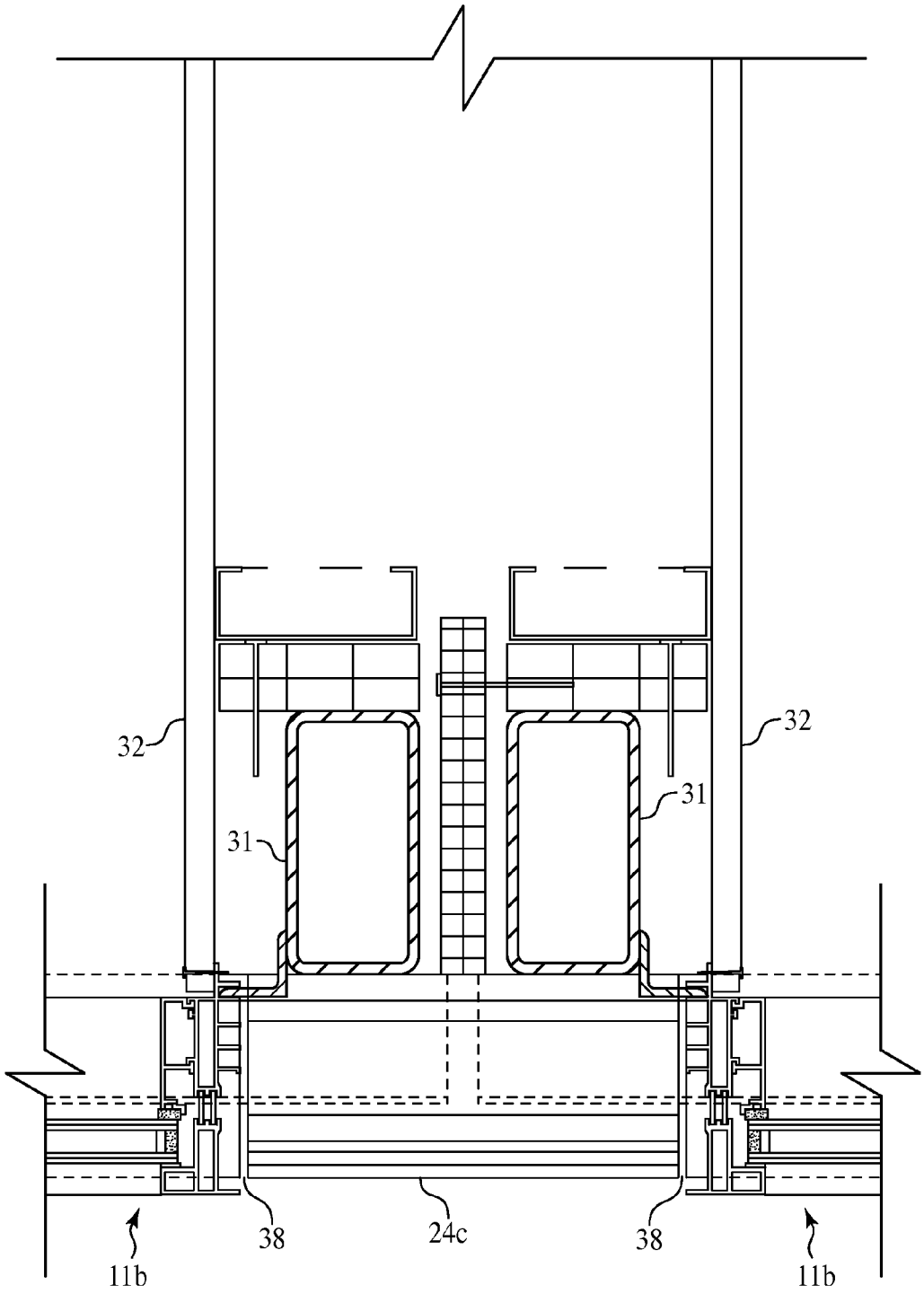
FIG. 3B shows the field installation of a short piece of positioning track onto the anchoring track bridging over the vertical butt joint of the modular units.

FIG. 3B shows the step of field installation of a short piece of base positioning track 24*c* bridging over the vertical butt joint of the modular units. The short piece of base positioning track 24*c* is installed by engagement onto the anchoring tracks 24*a* of corner wall panels 11*b* of adjacent modular units. The joint gaps 38 at the ends of the base positioning track 24*c* are then sealed using conventional field sealing procedures such as using backer rod and caulk. Apply similar procedures to the ceiling positioning track 28*c*.

Figure 3C:
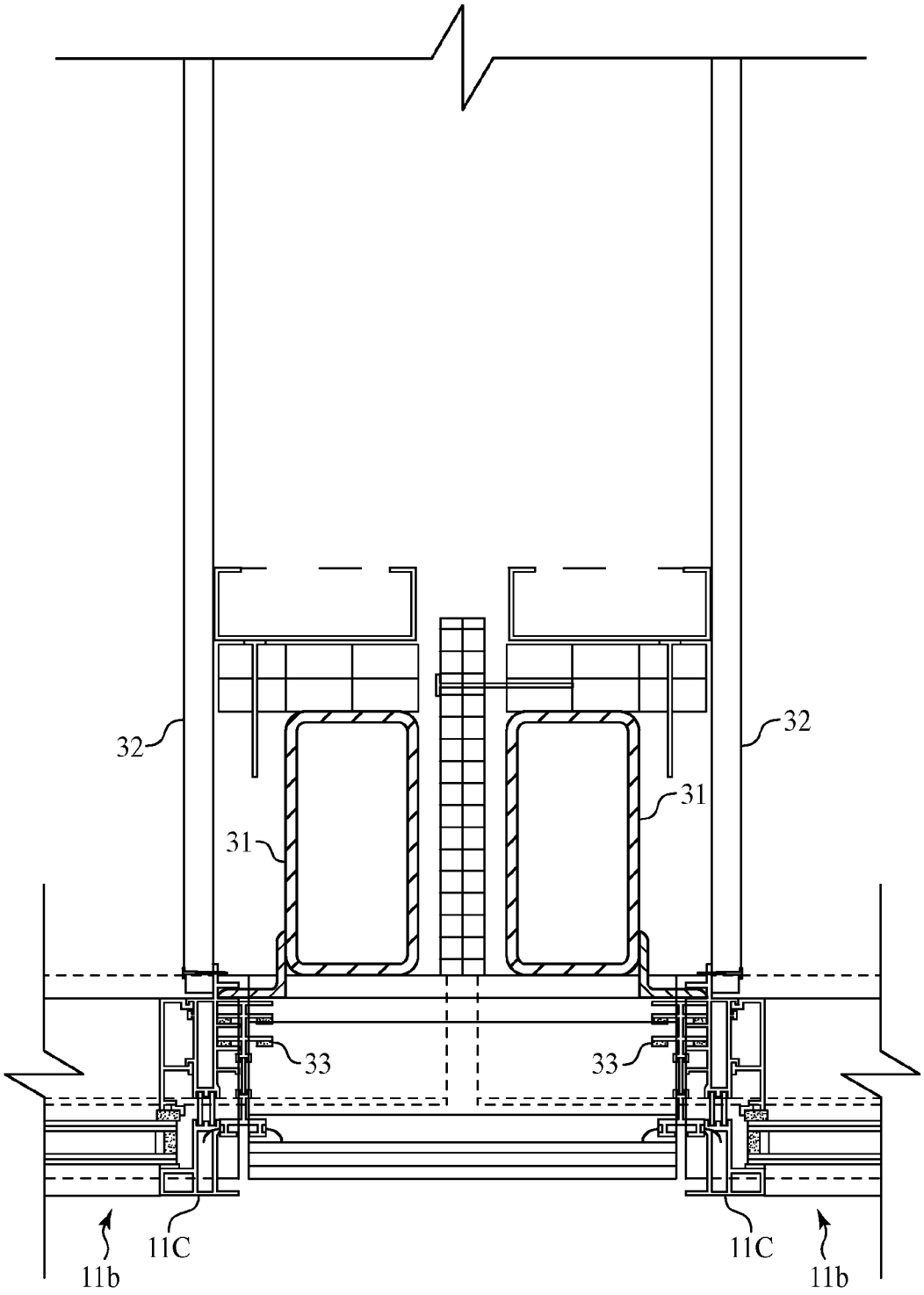
FIG. 3C shows the field installation of two Airloop vertical joint members onto the jamb members of the shop installed corner window wall panels.

FIG. 3C shows the step of field installation of two Airloop vertical joint members 33 with the deepest engagement onto the special jamb members 11*c* of the shop installed corner wall panels 11*b*. The deep engagement of the vertical joint members 33 opens up the butt joint gap to permit installation of the vertical butt joint wall panel 13.

Figure 3D:
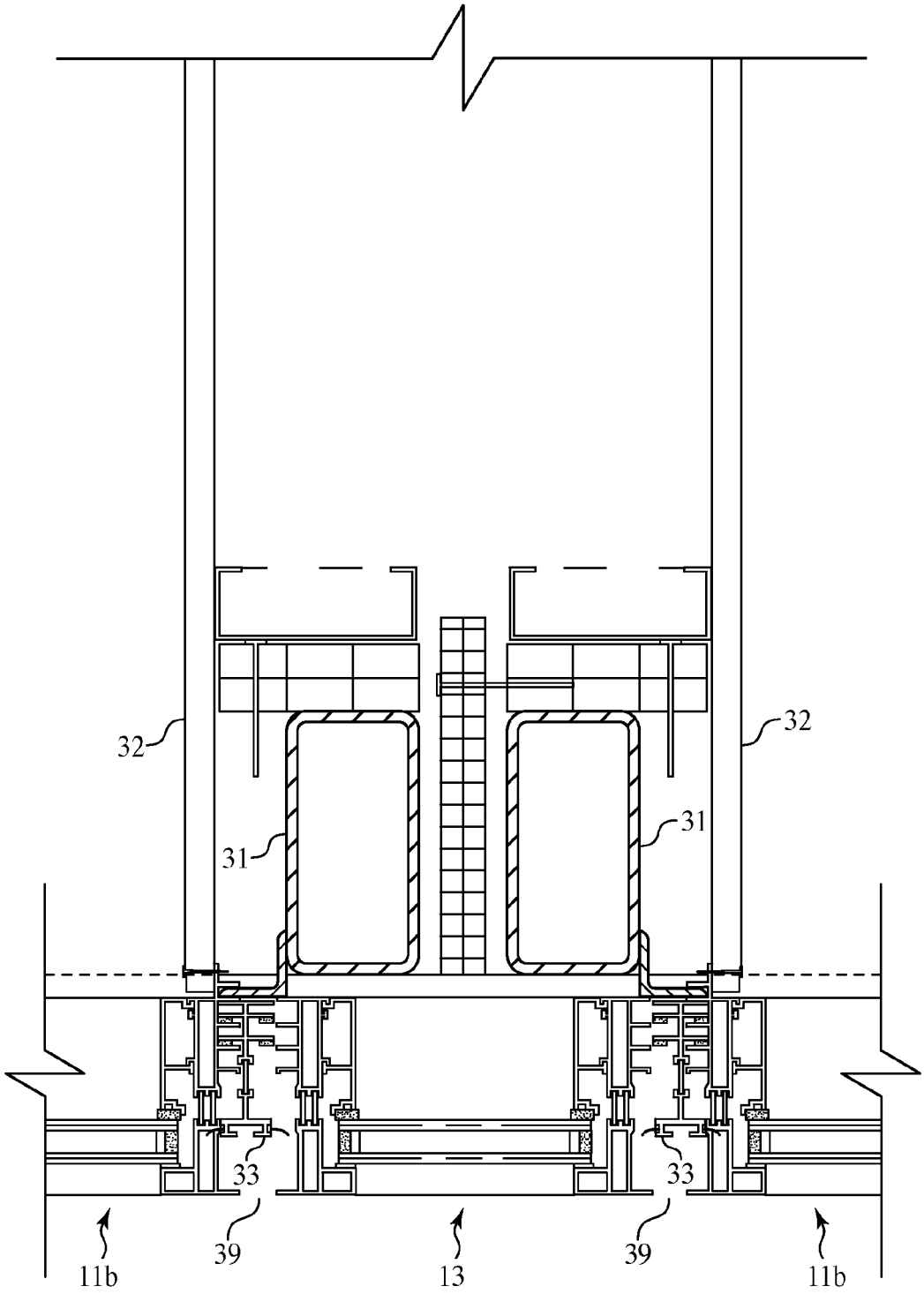
FIG. 3D shows the field installation of placing the vertical butt joint wall panel into position.

FIG. 3D shows the field installation of placing the vertical butt joint wall panel 13 into position. In the step shown in FIG. 3C, the butt joint gap is opened up to allow the vertical butt joint wall panel 13 to go straight into position by engaging the top and the bottom panel joints in the same manner described for corner wall panels 11*b* and regular wall panels 11. The final step is to move the Airloop vertical joint members 33 back to the center of the panel vertical joint gaps 39 with the final position as shown on FIG. 3.

The implementation of the Airloop Principle is explained in U.S. Pat. No. 8,001,738. From the above descriptions, the same Airloop window wall system is restored over both the horizontal and the vertical butt joints of the modular units with simple field installation procedures.

For illustrative purposes only, typical modular units with steel supporting members are shown. The same principles can be applied to other types of modular units such as reinforced concrete structures. For illustrative purposes only, Airloop window wall panels with exposed frames and singular insulated glass panes are shown. Any other variations in the Airloop window wall panels are applicable to the design of the present invention.

Nothing in the above description is meant to limit the present invention to any specific materials, geometry, or orientation of elements. Various changes could be made in the construction and methods disclosed above without departing from the scope of the invention are contemplated within the scope of the present invention and will be apparent to those skilled in the art. For example, facing materials other than glass may be used. The embodiments described herein were presented by way of example only and should not be used to limit the scope of the invention.

The invention claimed is:

1. An airloop window wall system for use in modular construction technology, comprising:

a first wall panel on a first modular building unit;

a second wall panel on a second modular building unit, wherein said first modular building unit and said second modular building unit meet at a vertical butt joint;

a base positioning track engaged with said first wall panel and engaged with said second wall panel, wherein said base positioning track bridges said vertical butt joint;

a vertical butt joint panel covering said vertical butt joint, wherein said vertical butt joint panel is engaged with a first vertical joint member engaged with said first wall panel, wherein said vertical butt joint panel is engaged with a second vertical joint member engaged with said second wall panel, and wherein said vertical butt joint panel is engaged with said base positioning track;

wherein each of first wall panel, second wall panel, and vertical butt joint panel comprises a head frame, a sill frame, and a jamb frame; and wherein air spaces in said first and second vertical joint members and each of said head frames, said sill frames, and said jamb frames are inter-connected to be pressure-equalized with exterior air.

2. The airloop window wall system of claim 1, wherein said first wall panel further comprises a special jamb frame, said special jamb frame comprising:

an inwardly extended part with a groove and a lip, wherein said groove is engaged with a structural member connected to said first modular building unit, and wherein said lip is connected to the end of an interior wall of said first modular building unit.

3. The airloop window wall system of claim 1, further comprising:

a third wall panel on a third modular building unit, wherein said first modular building unit and said third modular building unit meet at a horizontal butt joint;

a horizontal butt joint membrane attached to a base anchoring track of said third modular building unit, wherein said horizontal butt joint membrane spans said horizontal butt joint and prevents wetting of a floor slab of said third modular building unit and prevents wetting of a ceiling of said first modular building unit; and a horizontal butt joint cover covering said horizontal butt joint and attached to said first modular building unit and said third modular building unit.

* * * * *